US007100223B1

(12) United States Patent
Anthony

(10) Patent No.: US 7,100,223 B1
(45) Date of Patent: Sep. 5, 2006

(54) LONGITUDINALLY DIVIDED FITTED SHEET AN TOP SHEET COMBINATION

(75) Inventor: Jerlean Anthony, 17384 Kentfield, Detroit, MI (US) 48219

(73) Assignees: Jerlean Anthony, Detroit, MI (US); Peter D. Keefe, Roseville, MI (US)

( * ) Notice: Subject to any disclaimer, the term of this patent is extended or adjusted under 35 U.S.C. 154(b) by 0 days.

(21) Appl. No.: 11/208,363

(22) Filed: Aug. 19, 2005

Related U.S. Application Data

(63) Continuation-in-part of application No. 11/168,263, filed on Jun. 28, 2005, now abandoned.

(51) Int. Cl.
*A47G 9/02* (2006.01)

(52) U.S. Cl. ..... 5/486; 5/482

(58) Field of Classification Search ..... 5/486, 5/482, 497, 500, 413 R
See application file for complete search history.

(56) References Cited

U.S. PATENT DOCUMENTS

| | | | | |
|---|---|---|---|---|
| 2,662,234 | A | 12/1953 | Citron | |
| 3,072,776 | A * | 1/1963 | Quenneville | 219/212 |
| 3,508,285 | A * | 4/1970 | Marquette | 5/486 |
| 3,530,516 | A * | 9/1970 | Marquette | 5/486 |
| 3,962,739 | A | 6/1976 | Crockett | |
| 4,005,499 | A * | 2/1977 | Klein | 5/485 |
| 4,145,778 | A | 3/1979 | Ferrante et al. | |
| 4,161,044 | A | 7/1979 | Bogle | |
| 4,384,380 | A | 5/1983 | Glaha et al. | |
| 4,802,251 | A | 2/1989 | O'Dell | |
| 5,287,573 | A | 2/1994 | Ritacco | |
| 5,438,719 | A | 8/1995 | Anthony | |
| 6,108,836 | A | 8/2000 | Keene, III | |
| 6,226,814 | B1 | 5/2001 | Alexander | |
| 6,341,396 | B1 * | 1/2002 | Carapezza | 5/482 |
| 6,698,043 | B1 * | 3/2004 | Fabian | 5/486 |
| 2006/0059622 | A1 | 3/2006 | Haggerty | |

* cited by examiner

*Primary Examiner*—Alexander Grosz
(74) *Attorney, Agent, or Firm*—Peter D. Keefe

(57) ABSTRACT

A longitudinally divided fitted sheet and top sheet combination. The fitted sheet is longitudinally conjoined to the top sheet along a conjoining seam, wherein the conjoining seam demarcates a pair of separate and adjoining sleeping regions for a mattress to which the fitted sheet is fitted, wherein the top sheet is in overlaying relation to the fitted sheet.

20 Claims, 5 Drawing Sheets

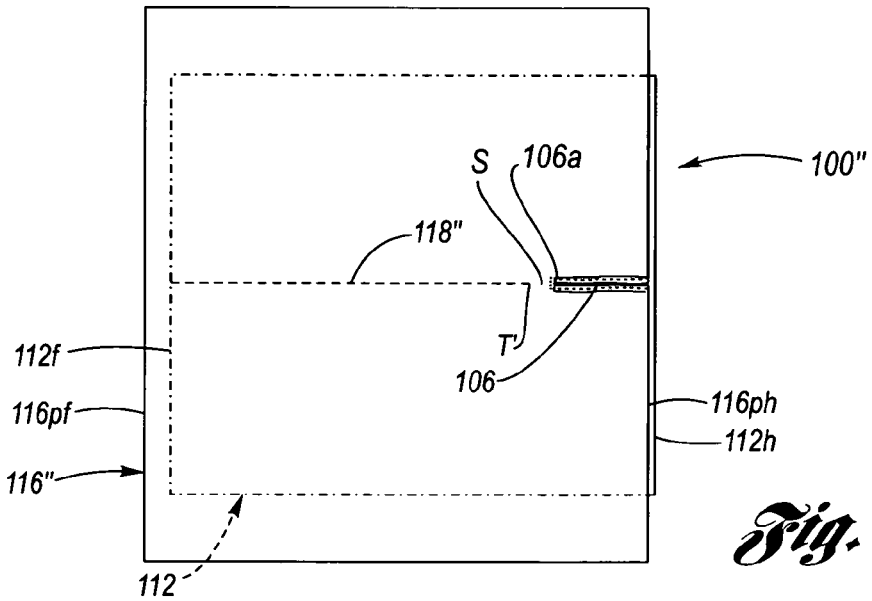
Fig. 7
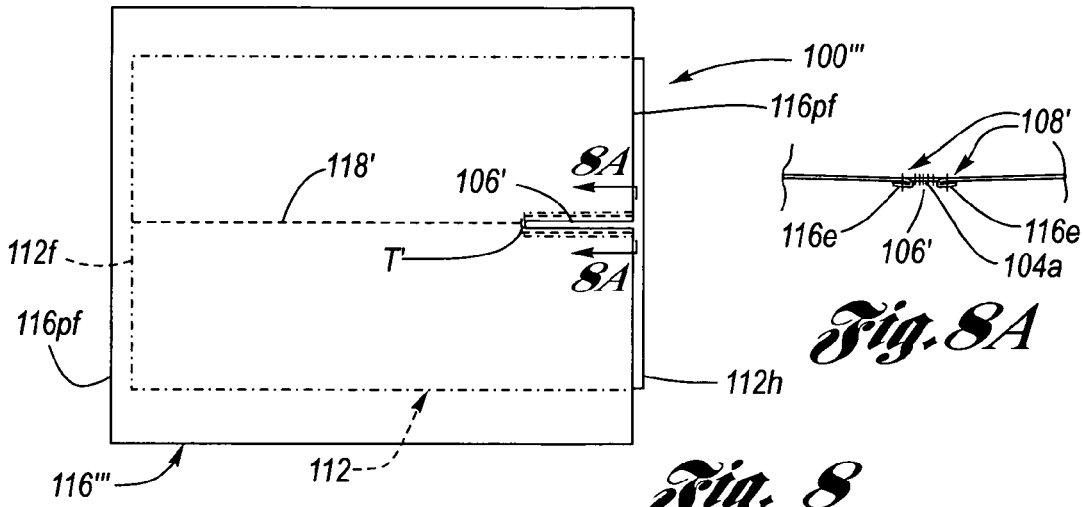
Fig. 8A
Fig. 8
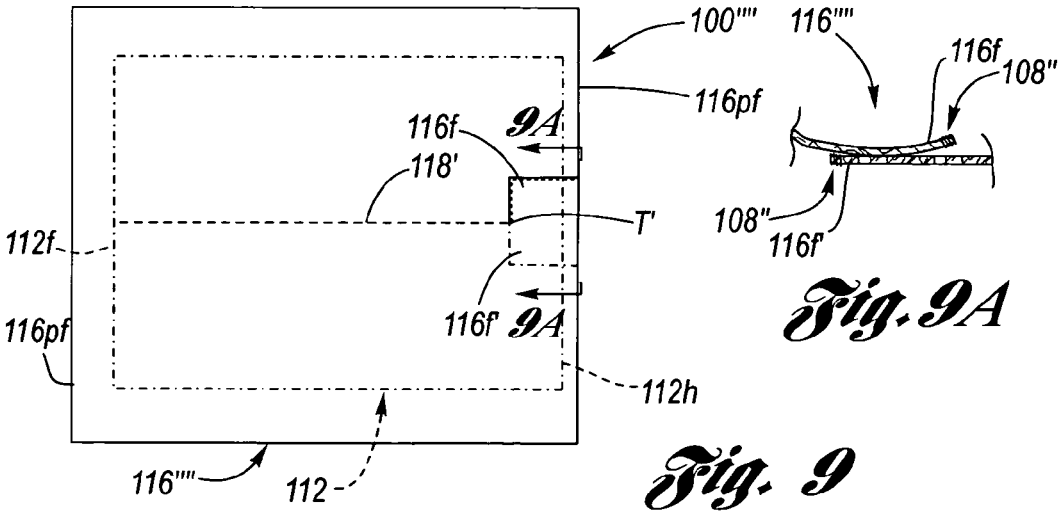
Fig. 9A
Fig. 9

LONGITUDINALLY DIVIDED FITTED SHEET AN TOP SHEET COMBINATION

CROSS-REFERENCE TO RELATED APPLICATIONS

The present application is a continuation-in-part application of application Ser. No. 11/168,263, filed on Jun. 28, 2005, which is now abandoned.

TECHNICAL FIELD

The present invention relates to bed sheets, and more particularly to a combination fitted sheet and top (or cover) sheet, wherein the two are conjoined along a generally medially disposed, longitudinally oriented conjoining seam to thereby provide a pair of adjoining, mutually separated sleeping regions of a bed.

BACKGROUND OF THE INVENTION

Customarily, a bed mattress is covered by a fitted sheet which spans the top and sides of the mattress, wherein an elastic gather is used to pull taught the fitted sheet at the sides or overlapping the bottom of the mattress. Upon the fitted sheet is placed a top (or cover) sheet, and upon that is placed a blanket or two, and a bed spread is usually placed thereover, as desired. This bedding arrangement is conventional and is ubiquitous in bedding applications.

However, occasions arise from time to time in which a bed must be shared by two persons who would prefer the comfort of sleeping in separate beds if they had the choice.

Accordingly, it would be extremely beneficial if somehow bedding could be arranged such that a single bed could provide two well demarcated, separated sleeping regions of the single bed to the satisfaction of those preferring to sleep in separate beds if such choice could otherwise be accommodated.

SUMMARY OF THE INVENTION

The present invention is a longitudinally divided fitted sheet and top sheet combination, wherein the fitted and top sheets are conjoined along a generally medially disposed, longitudinally oriented conjoining seam to thereby provide two well demarcated, mutually separated and adjoining sleeping regions of a single bed to the satisfaction of those preferring to sleep in separate beds if such choice could otherwise be accommodated.

The longitudinally divided fitted sheet and top sheet combination according to the present invention is composed of a fitted sheet, for example of a generally conventional construction as described hereinabove, and a top sheet, wherein the top sheet is conjoined to the fitted sheet along a preferably medially disposed, longitudinally oriented conjoining seam, preferably provided by sewing. On either side of the conjoining seam is provided separate, yet adjoining, sleeping regions of the mattress to which the fitted sheet is fitted upon.

It is preferred for the conjoining seam to run longitudinally along the fitted sheet so as to extend from at least the foot corner of the fitted sheet (defined by coincidence with the foot corner of the top of the mattress) to a terminal location of the conjoining seam spaced from the head corner of the fitted sheet (defined by coincidence with the head corner of the top of the mattress), wherein the terminal location is preferably located generally where a sleeper's shoulders, preferably near the under arms thereof, would ordinarily be placed when sleeping upon the fitted sheet (and the mattress upon which it is fitted).

In a first preferred embodiment of the present invention, the top sheet overlays the fitted sheet and has a peripheral head end located at, or adjacent to, the aforesaid terminal location, wherein the conjoining seam runs longitudinally at least from the foot corner of the fitted sheet to the terminal location along the longitudinal direction.

In a second preferred embodiment of the present invention, the top sheet overlays the fitted sheet, and terminates at a peripheral head end which is generally adjacent the head corner of the fitted sheet, wherein the conjoining seam also runs longitudinally from at least the foot corner of the fitted sheet to a terminal location spaced from the peripheral head end, and wherein a slit is provided in the top sheet from the peripheral head end thereof to, or generally adjacent to, the terminal location.

In operation of the longitudinally divided fitted sheet and top sheet combination according to the present invention, two persons are accommodated in a single bed, wherein the conjoining seam demarcates two separate and adjacent sleeping regions. Each sleeper enters and leaves the bed separately with respect to being covered by the top sheet and resting upon the fitted sheet, and each sleeper cannot crossover into the conjoining seam demarcated sleeping region of the other sleeper.

As regards blankets and bed spread placed upon the top sheet, it is preferred for these to be completely conventional so as to extend across the top sheet, wherein the two sleepers share the blankets and bed spread. However, the blanket and bed spread may be otherwise (ie., each sleeper may have his/her own).

Accordingly, it is an object of the present invention to provide a longitudinally divided fitted sheet and top sheet combination, wherein the fitted and top sheets are conjoined along a generally medially disposed, longitudinally oriented conjoining seam to thereby provide two well demarcated, separated and adjoining sleeping regions of a single bed to the satisfaction of those preferring to sleep in separate beds if such choice could otherwise be accommodated.

This and additional objects, features and advantages of the present invention will become clearer from the following specification of a preferred embodiment.

BRIEF DESCRIPTION OF THE DRAWINGS

FIG. 7 is a top plan view similar to FIG. 6 of a mattress covered by a longitudinally divided fitted sheet and top sheet combination, wherein now the slit has a terminus spaced from the terminal location of the conjoining seam.

FIG. 8 is a top plan view similar to FIG. 6 of a mattress covered by a longitudinally divided fitted sheet and top sheet combination, wherein now the slit is formed so that the edges of the slit provide hemming for the slit.

FIG. 8A is a cross-sectional view seen along lines 8A—8A of FIG. 8.

FIG. 9 is a top plan view similar to FIG. 6 of a mattress covered by a longitudinally divided fitted sheet and top sheet combination, wherein now a pair of flaps of the top sheet are provided at the slit, one flap, respectively, at each side of the slit.

FIG. 9A is a cross-sectional view seen along lines 9A—9A of FIG. 9.

DESCRIPTION OF THE PREFERRED EMBODIMENT

Figure 1:
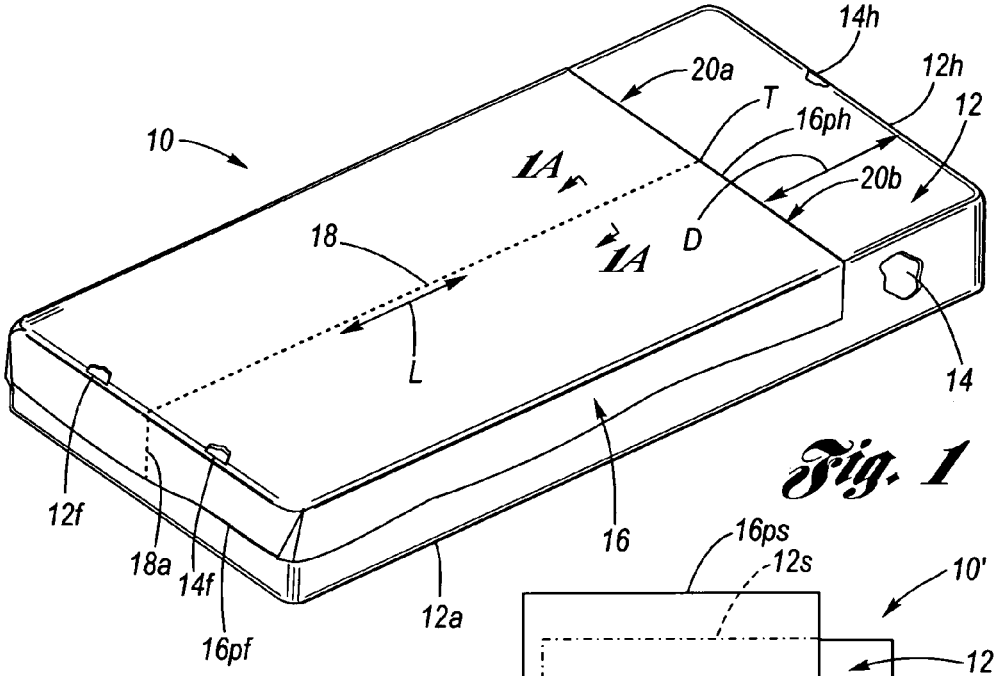
FIG. 1 is a perspective view of a mattress covered by a longitudinally divided fitted sheet and top sheet combination according to a first embodiment of the present invention.

Referring now to the Drawing, FIGS. 1 through 11 depict various views of a longitudinally divided fitted sheet and top sheet combination according to the present invention which affords two sleepers the advantage of a well defined and assuredly demarcated sleeping space for each sleeper that cannot be encroached upon by the other sleeper.

Referring firstly to FIGS. 1 through 4, a first embodiment of the longitudinally divided fitted sheet and top sheet combination according to the present invention will be detailed.

As shown at FIG. 1, the longitudinally divided fitted sheet and top sheet combination 10 includes a fitted sheet 12 for form fitting upon a mattress 14, and a top sheet 16, wherein the top sheet is conjoined to the fitted sheet along a preferably medially disposed conjoining seam 18 which is oriented longitudinally L. On either side of the conjoining seam 18 is provided separate, yet adjoining, sleeping regions 20*a*, 20*b* of the fitted sheet and top sheet combination upon a mattress 14 to which the fitted sheet has been fitted upon. The fitted sheet 12 is preferably of a generally conventional construction, whereby the fitted sheet fits conformingly over the mattress 14 on the top and sides thereof and is provided with an elastic gather 12*a* to grip the sides or overlap the bottom of the mattress.

It is preferred for the conjoining seam 18 to run longitudinally L along the fitted sheet 12 so as to extend from at least the foot corner 12*f* of the fitted sheet (defined by coincidence with the foot corner 14*f* of the top of the mattress 14, as indicated at FIG. 1) to a terminal location T spaced from the head corner 12*h* of the fitted sheet (defined by coincidence with the head corner 14*h* of the top of the mattress 14, as indicated at FIG. 1), wherein (see FIG. 4) the terminal location T is preferably generally at a sleeper's shoulders, preferably at or near the under arms thereof when sleeping upon the fitted sheet (and the mattress to which it is fitted).

Figure 1A:
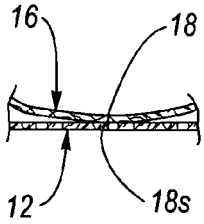
FIG. 1A is a cross-sectional view, seen along line 1A—1A in FIG. 1.

The conjoining seam 18 is preferably provided by sewing 18*s*, as shown at FIG. 1A; but, other modes of conjoining can be used, such as for example a plurality of linearly arranged snaps or hook and loop fastener.

By example, the conjoining seam 18 is shown in FIG. 1 running from the peripheral foot end 16*pf* of the top sheet 16, including a conjoining seam foot portion 18*a*, to the terminal location T. Alternatively, the longitudinally divided fitted sheet and top sheet combination 10' shown at FIG. 2 has the conjoining seam 18' running from the foot corner 12*f* of the fitted sheet 12 to the terminal location T, wherein in FIG. 2 the fitted sheet is fitted on the mattress as shown at FIG. 1, but the top sheet is flatly outstretched in the plane of the top of the mattress.

The top sheet 16 extends so as to overlay the fitted sheet 12. Preferably, as shown by the longitudinally divided fitted sheet and top sheet combination 10' of FIG. 2, the top sheet 16' has peripheral side ends 16*ps* that more generously overlay the side corners 12*s* of the fitted sheet 12 as compared with the amount the peripheral foot end 16*pf* overlays the foot corner 12*f* of the fitted sheet so that the sleepers each enjoy, respectively, a generous amount of top sheet.

Figure 2:
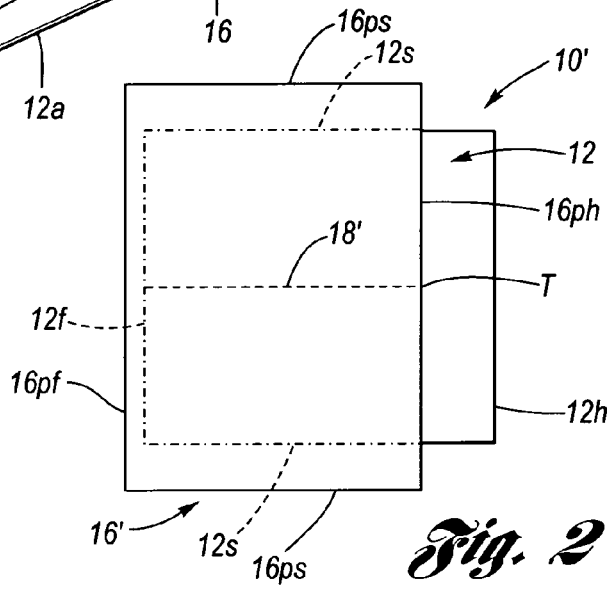
FIG. 2 is a top plan view of a mattress covered by a longitudinally divided fitted sheet and top sheet combination similar to that shown in FIG. 1, wherein the fitted sheet is shown fitted on the mattress and the top sheet shown in a spread-out, planar state parallel to the top of the mattress.

The top sheet 16, 16' has a peripheral head end 16*ph* that is located most preferably at, or adjacent, the aforesaid terminal location T, as shown at FIGS. 1 and 2. The conjoining seam 18, 18' runs longitudinally L at least from the foot corner 12*f* of the fitted sheet to the terminal location T. Although it is possible for the conjoining seam to be periodically interrupted along its length, it is preferred for the conjoining seam to be uninterrupted (particularly when it is provided by sewing).

Figure 2A:
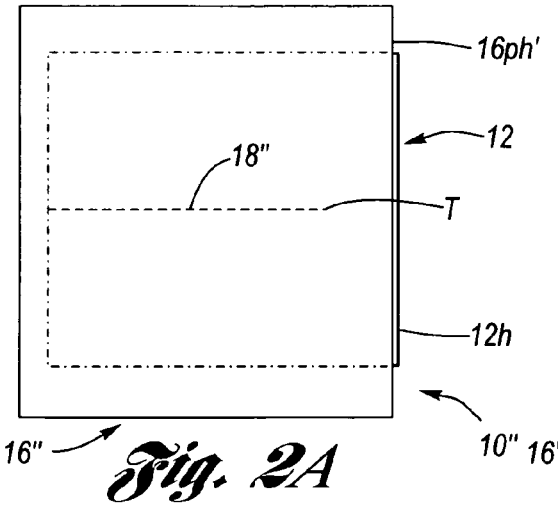
FIG. 2A is a top plan view similar to FIG. 2 of a mattress covered by a longitudinally divided fitted sheet and top sheet combination, wherein now the peripheral head end of the top sheet is distal from the terminal location of the conjoining seam.

It is possible to space, even distally space, the peripheral head end of the top sheet from the terminal location, but this is not as desirable as having the peripheral head end at, or adjacent to, the terminal location as discussed hereinabove and shown at FIGS. 1 and 2. In this regard, FIG. 2A shows a longitudinally divided fitted sheet and top sheet combination 10" in which the peripheral head end 16*ph'* of the top sheet 16" is distally spaced from the terminal location T of the conjoining seam 18', wherein the peripheral head end is, in this example, located adjacent the head corner 12*h* of the fitted sheet 12. Further, it is possible, as exemplified by the longitudinally divided fitted sheet and top sheet combination 10'" of FIG. 2B, to place the terminal location T of the conjoining seam 18'" elsewhere than at the sleepers' shoulders location, such as for example generally adjacent the head corner 12*h* of the fitted sheet 12, although this is less desirable than having the terminal location at the sleepers' shoulders.

Figure 3:
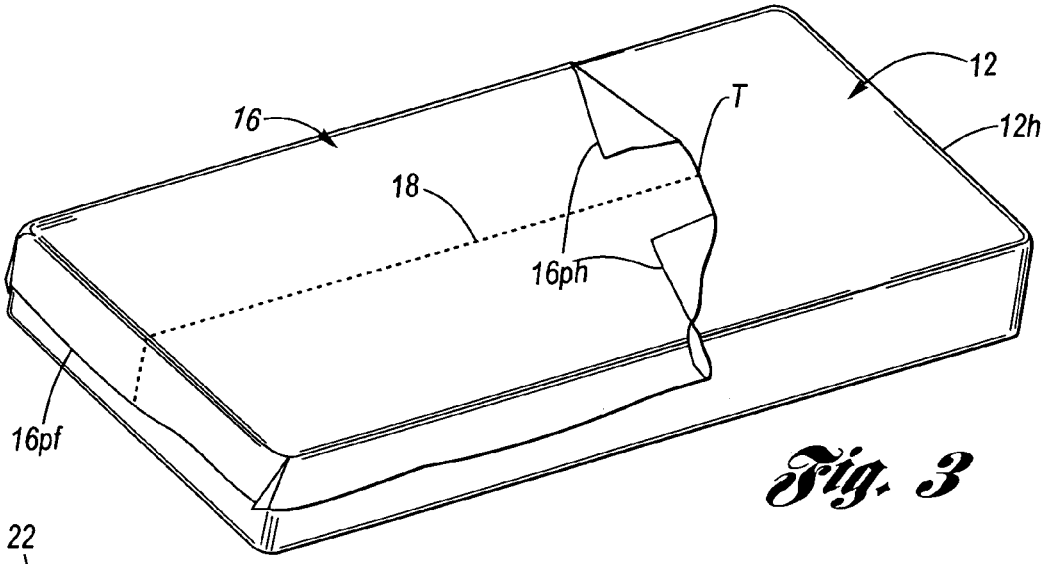
FIG. 3 is a perspective view of a mattress covered by a longitudinally divided fitted sheet and top sheet combination as in FIG. 1, wherein now a top portion of each sleeping region of the top sheet is folded down in anticipation of each sleeper's separate entry.
Figure 4:
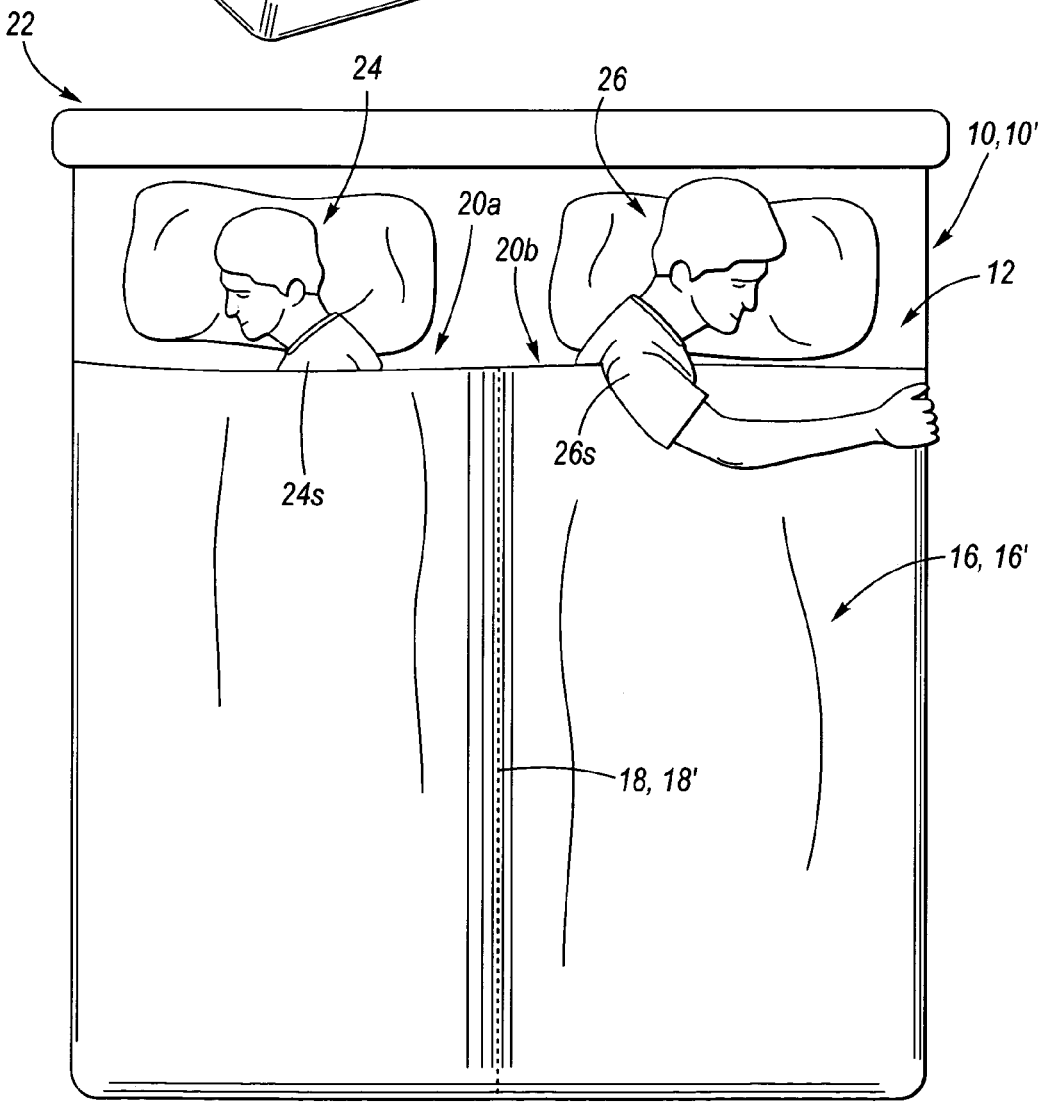
FIG. 4 is a top plan view of a bed including a mattress covered by a longitudinally divided fitted sheet and top sheet combination of either FIG. 1 or FIG. 2, shown in operation with respect to a pair of sleepers.

Referring now to FIGS. 3 and 4, operation of the first preferred embodiment of the longitudinally divided fitted sheet and top sheet combination 10, 10' will be detailed, wherein the fitted sheet 12 is form fitted onto the mattress (not visible in FIG. 4, but is the same as the mattress 14 shown in FIG. 1) of a bed 22. Two persons 24, 26 are accommodated in the bed 22, wherein the seam 18, 18' demarcates two separate and adjoining sleeping regions 20*a*, 20*b*, and wherein each person (sleeper) enters and leaves the bed separately with respect to being covered by the top sheet 16, 16' and laying upon the fitted sheet 12, and each person (sleeper) cannot cross-over into the conjoining seam demarcated sleeping region of the other person (sleeper). In the first embodiment, it is seen that the terminal location T is at the shoulders 24*s*, 26*s*, preferably near the under arms, of the sleepers 24, 26. Generally speaking by way merely of exemplification, the location of the terminal location may be disposed a distance D (see FIG. 1) of between about twelve inches and twenty-four inches, most preferably about 18 inches, from the head corner 12*h* of the fitted sheet 12.

Figure 2B:
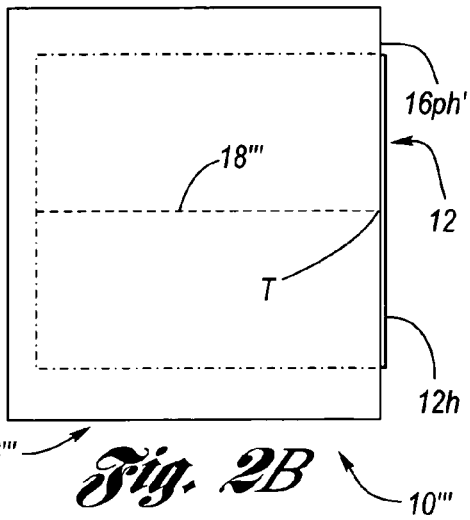
FIG. 2B is a top plan view similar to FIG. 2 of a mattress covered by a longitudinally divided fitted sheet and top sheet combination, wherein now the peripheral head end of the top sheet is adjacent the head corner of the fitted sheet and coincides with the terminal location of the conjoining seam.

With respect to the version of the first embodiment of the longitudinally divided fitted sheet and top sheet combination 10", 10'" shown at FIGS. 2A and 2B, operation is generally the same as described above, wherein now the portion of the top sheet in the area near the head corner of the fitted sheet is folded, crunched-up or otherwise manipulated by each of the sleepers to suit their fancies (as for example, covering in part the head or heads, respectively, or wrapping around the neck or necks, respectively).

Referring next to FIGS. 5 through 11, a second embodiment of the longitudinally divided fitted sheet and top sheet combination according to the present invention will now be detailed.

Figure 5:
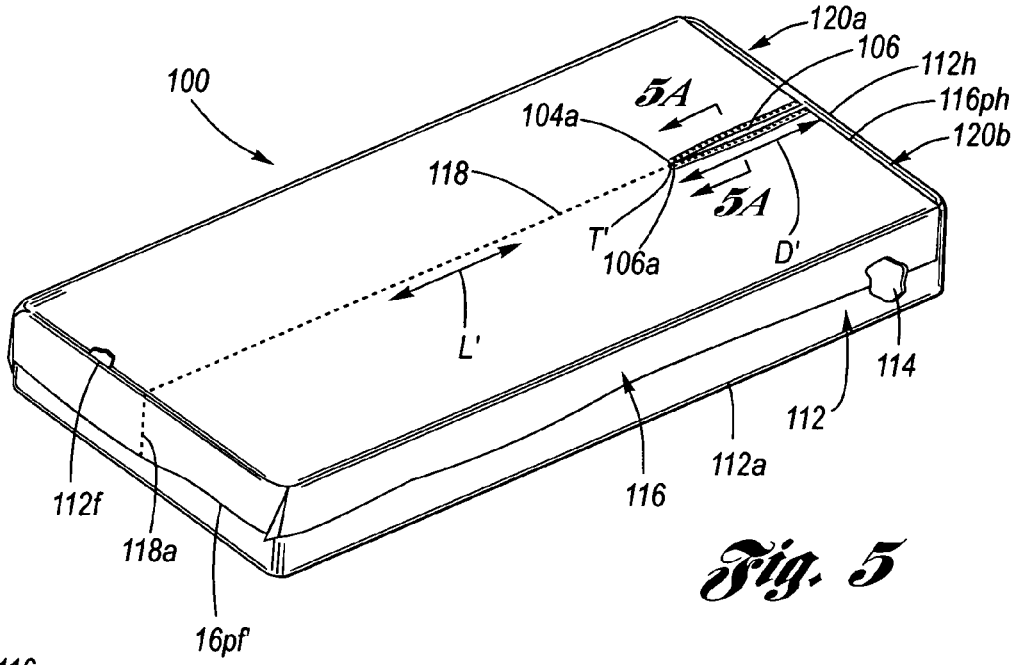
FIG. 5 is a perspective view of a mattress covered by a longitudinally divided fitted sheet and top sheet combination according to a second embodiment of the present invention.

As shown at FIG. 5, the longitudinally divided fitted sheet and top sheet combination 100 includes a fitted sheet 112 for form fitting upon a mattress 114, and a top sheet 116, wherein the top sheet is conjoined to the fitted sheet along a preferably medially disposed conjoining seam 118 which is oriented longitudinally L'. On either side of the conjoining seam 118 is provided separate, yet adjoining, sleeping regions 120*a*, 120*b* of the fitted sheet and top sheet combination upon the mattress 114 to which the fitted sheet has been fitted upon. As in the case of the first embodiment described hereinabove, the fitted sheet 112 is preferably of a generally conventional construction, whereby the fitted sheet fits conformingly over the mattress 114 on the top and sides thereof and is provided with an elastic gather 112*a* to grip the sides or overlap the bottom of the mattress.

It is preferred for the conjoining seam 118 to run longitudinally L' along the fitted sheet so as to extend from at least the foot corner 112*f* of the fitted sheet 112 (defined by the foot corner of the top of the mattress as shown at FIG. 1) to a terminal location T' of the conjoining seam spaced from the head corner 112*h* of the fitted sheet (defined by the head corner of the top of the mattress as shown at FIG. 1), wherein (see FIG. 11) the terminal location is preferably generally at a sleeper's shoulders, preferably at or near the under arms thereof when sleeping upon the fitted sheet (and the mattress to which it is fitted).

The conjoining seam 118 is preferably provided by sewing as has been depicted and described above with respect to FIG. 1A, or otherwise conjoined, as for example by a plurality of linearly arranged snaps or hook and loop fastener.

By example, the conjoining seam 118 is shown in FIG. 5 running from the peripheral foot end 116*pf* of the top sheet 116 so as to include a conjoining seam portion 118*a*. Alternatively, the longitudinally divided fitted sheet and top sheet combination 100' shown at FIG. 6 has the conjoining seam 118' running from the foot corner 112*f* of the fitted sheet 112, wherein in FIG. 6 the fitted sheet is fitted on the mattress as shown at FIG. 5, but the top sheet is flatly outstretched in the plane of the top of the mattress.

The top sheet 116 extends so as to overlay the fitted sheet 112. Preferably, as shown by the longitudinally divided fitted sheet and top sheet combination 100' of FIG. 6, the top sheet 116' has peripheral side ends 116*ps* that more generously overlay the side corners 112*s* of the fitted sheet 112 as compared with the amount the peripheral foot end 16*pf* overlays the foot corner 112*f* of the fitted sheet so that the sleepers each enjoy, respectively, a generous amount of top sheet.

The top sheet 116, 116' has a peripheral head end 116*ph* that is located adjacent the head corner 112*h* of the fitted sheet 112, wherein the conjoining seam 118, 118' runs longitudinally L' at least from the foot corner 112*f* of the fitted sheet to the terminal location T' of the conjoining seam. Although it is possible for the conjoining seam to be periodically interrupted along its length, it is preferred for the conjoining seam to be uninterrupted (particularly when it is provided by sewing).

A slit 106 is formed in the top sheet 116, 116' in alignment with the conjoining seam 118, 118' and extends from the peripheral head end 116*ph* of the top sheet to preferably the aforesaid terminal location T'. Generally speaking by way merely of exemplification, the slit 106 may extend a distance D', which distance is preferably the same as, or about the same as, the disposition distance of the terminal location T' with respect to the head corner 112*h* of the fitted sheet 112 (see FIG. 5) of between about twelve inches and twenty-four inches, most preferably about 18 inches.

Figure 5A:
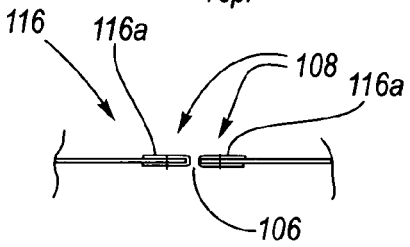
FIG. 5A is a cross-sectional view seen along lines 5A—5A of FIG. 5.
Figure 6A:
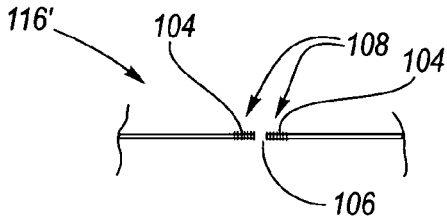
FIG. 6A is a cross-sectional view seen along lines 6A—6A of FIG. 6.

As shown at FIGS. 5A and 6A it is preferred for the slit edges of the top sheet 116, 116' at the slit 106 to be hemmed 108 to prevent fraying at the top sheet edges along the slit. FIG. 5A shows a form of hemming 108 in which a strip of sheet or bias tape 116*a*, which may, or may not, be of the same material and pattern of the top sheet 116, 116', is bent over each slit edge of the slit 106, respectively, and then sewed to the top sheet adjacent the slit. Alternatively, FIG. 6A shows that rather than using strips of sheet or bias tape, stitching 104, as for example a hemstitch, is used adjacent the slit edges to form the hemming 108. It should be noted that at the terminus 106*a* of the slit 106, the top sheet is sewed 104*a* to the fitted sheet transversely so that fraying thereat is prevented.

Figure 6:
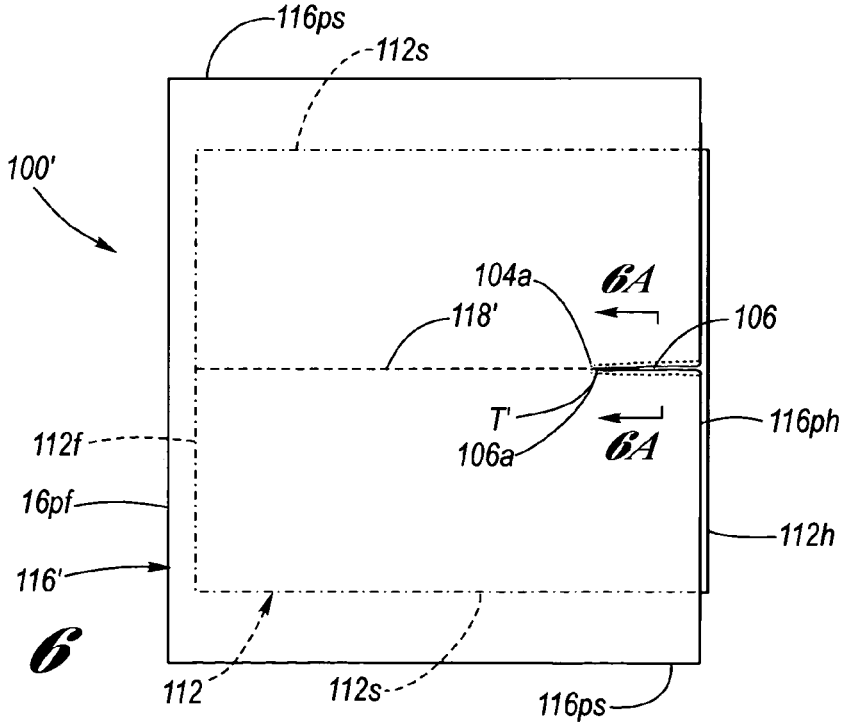
FIG. 6 is a top plan view of a mattress covered by a longitudinally divided fitted sheet and top sheet combination similar to FIG. 5, wherein the fitted sheet is shown fitted on the mattress and the top sheet is shown in a spread-out, planar state parallel to the top of the mattress.

FIG. 7 depicts a view similar to that of FIG. 6 of a longitudinally divided fitted sheet and top sheet combination 100", wherein now the top sheet 116" is modified in that the terminal location T' of the conjoining seam 118" is spaced a distance S from the terminus 106*a* of the slit 106. The distance S can be any reasonable distance.

Referring now to FIGS. 8 and 8A, a view similar to FIG. 6 is presented of a longitudinally divided fitted sheet and top sheet combination 100'", wherein now the top sheet 116'" has an alternative hemming 108' provided by the slit 106' being widened (forming a narrow, elongated slot) and edge portions 116*e* of the top sheet 116'" at the slit edges being folded-over and then sewed along the slit edge. This version of the present invention is presently most preferred.

Turning attention next to FIGS. 9 and 9A, another view similar to that of FIG. 6 of a longitudinally divided fitted sheet and top sheet combination 100" is shown, wherein now the top sheet 116" is modified in that the slit edge portions of the top sheet are now flaps 116*f*, 116*f'*. Hems 108" are provided at the ends of the flaps 116*f*, 116*f'*.

Figure 10:
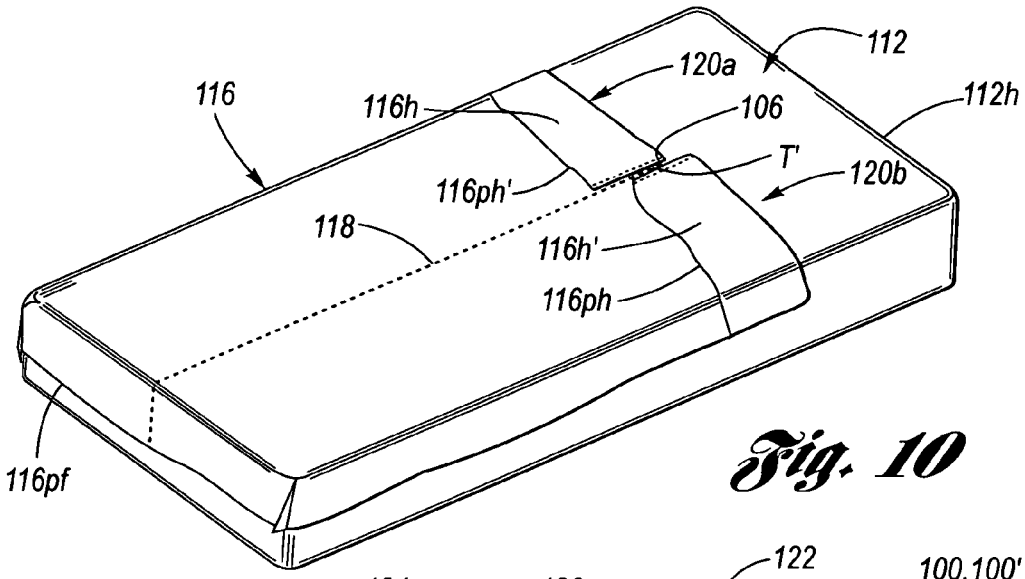
FIG. 10 is a perspective view of a mattress covered by a longitudinally divided fitted sheet and top sheet combination as in FIG. 5, wherein now the head portion of each of the sleeping regions of the top sheet is folded down in anticipation of each sleeper's separate entry.
Figure 11:
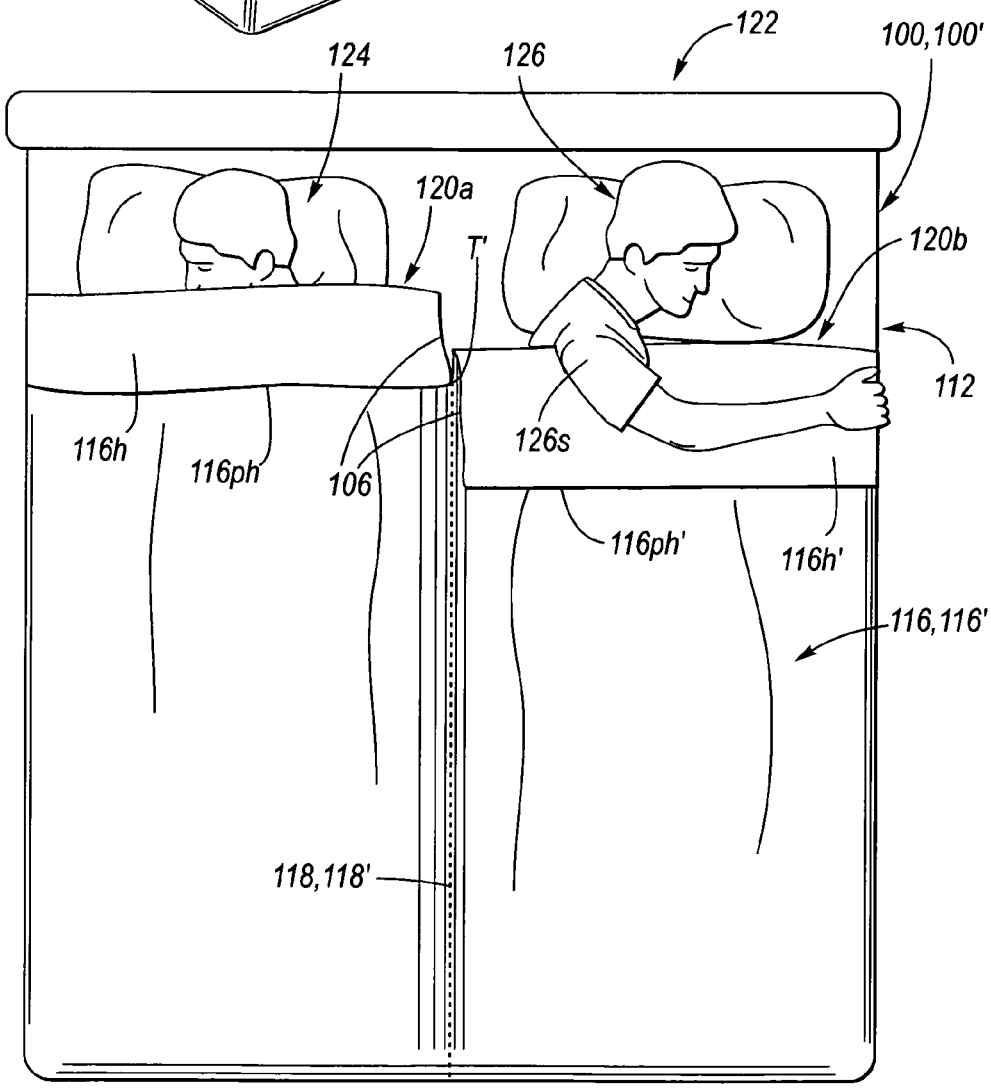
FIG. 11 is a top plan view of a bed including the mattress covered by a longitudinally divided fitted sheet and top sheet combination of either FIG. 5 or FIG. 6, shown in operation with respect to a pair of sleepers.

Referring now to FIGS. 10 and 11, operation of the second embodiment of the longitudinally divided fitted sheet and top sheet combination 100, 100' will be detailed, wherein, the fitted sheet 112 is form fitted onto the mattress (not visible in FIG. 11, but is the same as the mattress 114 shown in FIG. 5) of a bed 122. Two persons 124, 126 are accommodated in the bed 122, wherein the conjoining seam 118, 118' demarcates two separate and adjoining sleeping regions 120*a*, 120*b*, and wherein each person (sleeper) enters and leaves the bed separately with respect to being covered by the top sheet 116, 116' and laying upon the fitted sheet 112, and each person (sleeper) cannot cross-over into the conjoining seam demarcated sleeping region of the other person. In this second embodiment, it is seen that each of the head end portions 116*h*, 116*h'* of the top sheet (that is, the portions of the top sheet between the terminal location T' and the peripheral head end 116*ph*) can be individually and independently selectively folded down as far as desired by the individual taste of the sleepers. Preferably, the terminal location T' is located at the shoulders, preferably near the under arms thereof, of the sleepers (see shoulder 126*s* of person (sleeper) 126). Each of the head end portions 116*h*, 116*h'* of the top sheet is, separately and individually, folded, crunched-up or otherwise manipulated by each of the sleepers to suit their fancies (as for example, covering in part the head or heads, respectively, or wrapping around the neck or necks, respectively).

It is to be noted that operation of the longitudinally divided fitted sheet and top sheet combination 100", 100'" shown at FIGS. 7, 8 and 8A is the same as just described. Further, operation of the longitudinally divided fitted sheet and top sheet combination 100" shown at FIGS. 9 and 9A, is generally the same as described above; however, now additionally each of the flaps 116*f*, 116*f'* of the head end portions of the top sheet is, separately and individually, folded, crunched-up or otherwise manipulated with its respective head end portion by each of the sleepers to suit their fancies (as for example, covering in part the head or heads, respectively, or wrapping around the neck or necks, respectively).

With respect to blankets and bed spread placed upon the top sheet of the second embodiment of the present invention, it is preferred for these to be completely conventional so as to extend across the top sheet, wherein the two sleepers share the blankets and bed spread. However, the blanket and bed spread may be otherwise (ie., each sleeper may have his/her own).

To those skilled in the art to which this invention appertains, the above described preferred embodiment may be subject to change or modification. For example, while it is preferred for the medial disposition of the seam to be the at the longitudinal bisection of the fitted sheet, the seam may be shifted laterally from the medial bisection in order to suit certain circumstances, as for example in a situation where the pair of sleepers consists of one being large sized and the other being small sized (relatively speaking), such as a mother and her child. Additionally, any of the various examples shown may be mixed with any other of the examples to provide a longitudinally divided fitted sheet and top sheet combination, the configuration thereby derived being a hybrid thereof and, therefore, not specifically shown in the various figures. Further, it is intended that the longitudinally divided fitted sheet and top sheet combination according to the present invention is to be used with any size mattress, including, for example, full, twin, queen and king sizes, although for practical reasons, wider mattresses such as queen and king, are more preferred, but this depends upon the size of the sleepers, as a pair child sleepers would be very comfortably accommodated on a twin or full size mattress. Such change or modification can be carried out without departing from the scope of the invention, which is intended to be limited only by the scope of the appended claims.

The invention claimed is:

1. A longitudinally divided fitted sheet and top sheet combination, comprising:

a fitted sheet;

a top sheet; and a conjoining seam longitudinally connecting said top sheet to said fitted sheet;

wherein said conjoining seam is generally medially disposed in relation to said fitted sheet; and wherein said conjoining seam demarcates a pair of mutually separate and adjoining sleeping regions when said top sheet overlays said fitted sheet.

2. The combination of claim 1, wherein said fitted sheet has a foot corner and an opposite head corner; wherein said top sheet has a peripheral foot end and an opposite peripheral head end; and wherein said conjoining seam extends generally between at least said foot corner of said fitted sheet and a terminal location disposed a predetermined distance from said head corner of said fitted sheet.

3. The combination of claim 2, wherein said peripheral head end of said top sheet is located substantially at said terminal location.

4. The combination of claim 3, wherein said predetermined distance is substantially between about twelve inches and about twenty-four inches.

5. The combination of claim 4, wherein said conjoining seam further extends to said peripheral foot end of said top sheet.

6. The combination of claim 2, wherein said fitted sheet further has a pair of side corners; wherein said top sheet further has a pair of peripheral side ends; and wherein each of said peripheral side ends overlaps a respective said side corner a further extent than said peripheral foot end overlaps said foot corner.

7. The combination of claim 2, wherein said peripheral head end of said top sheet is located substantially adjacent said head corner of said fitted sheet; wherein said top sheet has a slit extending from said peripheral head end to substantially said terminal location, wherein said slit is aligned with said conjoining seam.

8. The combination of claim 7, wherein said predetermined distance is substantially between about twelve inches and about twenty-four inches.

9. The combination of claim 8, wherein said conjoining seam further extends to said peripheral foot end of said top sheet.

10. A mattress and longitudinally divided fitted sheet and top sheet combination, comprising:

a mattress;

a fitted sheet conformingly fitted onto said mattress;

a top sheet overlaying said fitted sheet; and a conjoining seam longitudinally connecting said top sheet to said fitted sheet, said conjoining seam being generally medially disposed in relation to said fitted sheet;

wherein said conjoining seam demarcates a pair of mutually separate and adjoining sleeping regions.

11. The mattress and combination of claim 10, wherein said fitted sheet has a foot corner and an opposite head corner; wherein said top sheet has a peripheral foot end and an opposite peripheral head end; and wherein said conjoining seam extends generally between at least said foot corner of said fitted sheet and a terminal location disposed a predetermined distance from said head corner of said fitted sheet.

12. The combination of claim 11, wherein said fitted sheet further has a pair of side corners; wherein said top sheet further has a pair of peripheral side ends; and wherein each of said peripheral side ends overlaps a respective said side corner a further extent than said peripheral foot end overlaps said foot corner.

13. The mattress and combination of claim 11, wherein said peripheral head end of said top sheet is located substantially at said terminal location.

14. The mattress and combination of claim 13, and wherein said predetermined distance is substantially between about twelve inches and about twenty-four inches.

15. The mattress and combination of claim 14, wherein said conjoining seam further extends to said peripheral foot end of said top sheet.

16. The mattress and combination of claim 11, wherein said peripheral head end of said top sheet is located substantially adjacent said head corner of said fitted sheet; wherein said top sheet has a slit extending from said peripheral head end to substantially said terminal location, wherein said slit is aligned with said conjoining seam.

17. The mattress and combination of claim 16, and wherein said predetermined distance is substantially between about twelve inches and about twenty-four inches.

18. The mattress and combination of claim 17, wherein said conjoining seam further extends to said peripheral foot end of said top sheet.

19. A method of providing a pair of longitudinally divided sleeping regions for a bed, comprising the steps of:

conjoining a top sheet to a fitted sheet, wherein the conjoining is longitudinally disposed in relation to the foot and head corners of the fitted sheet, and wherein the conjoining is generally medially disposed in relation to the fitted sheet;

fitting the fitted sheet to a mattress; and overlaying the top sheet in relation to the fitted sheet to thereby provide a pair of mutually separate and adjoining sleeping regions in relation to the mattress, wherein the sleeping regions are demarcated by the conjoining.

20. The method of claim 19, further comprising:

forming a slit in said top sheet between a peripheral head end thereof and substantially a terminal location of the conjoining.

* * * * *